US007066222B2

(12) United States Patent
Yontrarak

(10) Patent No.: US 7,066,222 B2
(45) Date of Patent: Jun. 27, 2006

(54) VENEER SLICER

(76) Inventor: Bunlue Yontrarak, 12/70 Inthamara 33 Lane 1, Dindaeng, Bangkok (TH) 10400

( * ) Notice: Subject to any disclaimer, the term of this patent is extended or adjusted under 35 U.S.C. 154(b) by 169 days.

(21) Appl. No.: 10/784,684

(22) Filed: Feb. 23, 2004

(65) Prior Publication Data

US 2004/0211488 A1 Oct. 28, 2004

(30) Foreign Application Priority Data

Feb. 21, 2003 (TH) ..... 080279

(51) Int. Cl.
*B27C 1/00* (2006.01)

(52) U.S. Cl. ..... 144/178; 144/162.1; 144/242.1; 83/643; 83/644

(58) Field of Classification Search ..... 144/178, 144/2.1, 243, 177, 242.1, 162.1, 180, 181.2; 83/643, 644
See application file for complete search history.

(56) References Cited

U.S. PATENT DOCUMENTS

| | | | | |
|---|---|---|---|---|
| 131,094 A | | 9/1872 | Gilmore | |
| 674,562 A | * | 5/1901 | Kraus | 144/162.1 |
| 1,143,081 A | | 6/1915 | Shellenberger | |
| 1,415,470 A | | 5/1922 | Postel-Vinay | |
| 1,474,337 A | | 11/1923 | Carrier | |
| 1,793,842 A | | 2/1931 | Dalen | |
| 1,799,814 A | | 4/1931 | Hommel | |
| 1,814,726 A | | 7/1931 | Miller | |
| 1,828,873 A | | 10/1931 | Miller | |
| 1,986,685 A | * | 1/1935 | Soderberg | 83/646 |
| 2,008,317 A | | 6/1935 | Voigt | |
| 2,592,782 A | | 4/1952 | Zweifel, et al. | |
| 2,604,913 A | | 7/1952 | Bamford | |
| 3,750,725 A | * | 8/1973 | Cremona | 144/178 |
| 4,204,450 A | * | 5/1980 | Le Guelennec | 83/461 |
| 4,328,729 A | * | 5/1982 | Bartesaghi | 83/568 |

OTHER PUBLICATIONS

Abstract of JP7068511.

* cited by examiner

*Primary Examiner*—Bena Miller
(74) *Attorney, Agent, or Firm*—Ladas & Parry LLP

(57) ABSTRACT

In a slicer having a table for supporting a workpiece from which a slice is to be sliced, a knife is linked at opposite end portions of the knife to cranks for moving the knife in strokes having components generally transverse and parallel to the knife. The table with supported workpiece moves toward the knife while the knife moves for making the slice.

30 Claims, 1 Drawing Sheet

VENEER SLICER

BACKGROUND OF THE INVENTION

The invention relates to a slicer and, more particularly, to a slicer for slicing veneers from plastic, metal or wood and, especially, hard, dried, unheated wood.

A veneer cutter or slicer is known from Kraus U.S. Pat. No. 674,562 of May 21, 1901, to have eccentrics or cranks connected to opposite end portions of a knife. Rotation of the cranks then moves the knife up and down generally transversely to its blade, which causes a link pivotally connecting the knife to a frame to impart an additional end-to-end motion to the knife generally parallel to its blade.

A similar veneer cutter is known from Cremona U.S. Pat. No. 3,750,725 of Aug. 7, 1973. The angle of the workpiece to be cut to the knife is controllably variable in this patent as compared to the Kraus Patent in which it is not.

However, neither Patent considers controlling the lengths of the strokes of the up-and-down and end-to-end movements, the phases of the strokes or the frequencies of the strokes, whereby their devices are not suitable for cutting thicker veneers from hard, dried, unheated wood, for example.

Veneers made by such slicers have been subjected to pushing forces and impact forces during the slicing process, causing large cracks (loose grain or un-tight grain), rough faces and damaged, not beautiful textures with broken grains and fibers. Natural strength is reduced. As a result, dried hardwoods cannot be sliced in this way into thick veneers of commercially acceptable quality.

SUMMARY OF THE INVENTION

In a slicer having a table for supporting a workpiece from which a slice is to be sliced, a knife is linked at opposite end portions of the knife to cranks for moving the knife in strokes having components generally transverse and parallel to the knife. The table with supported workpiece moves toward the described knife while the knife moves for making the slice.

BRIEF DESCRIPTION OF THE DRAWING

In a drawing of a preferred embodiment that illustrates but does not limit the invention.

DESCRIPTION OF PREFERRED EMBODIMENTS

Figure 1:
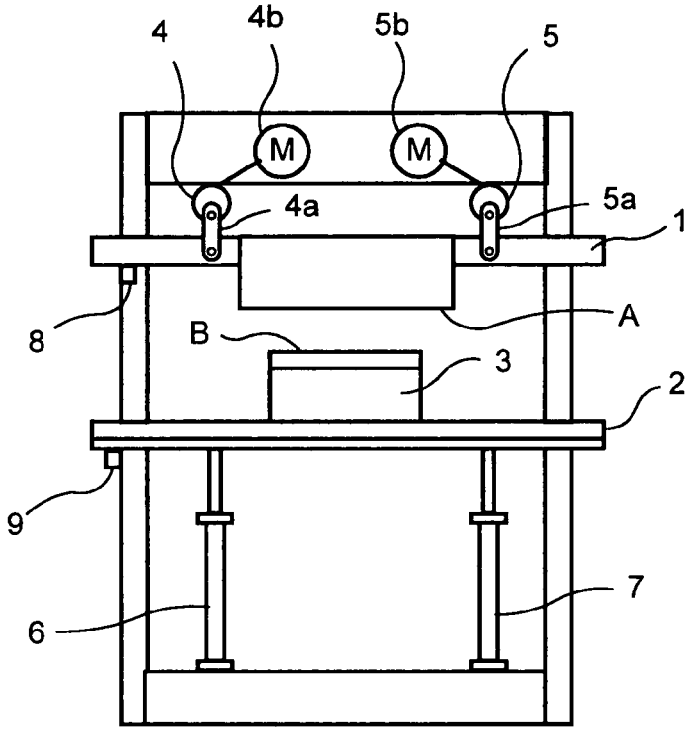
FIG. 1 is a front elevational schematic of a slicer.

As shown in FIG. 1, a knife assembly 1 has a knife with a knife edge A. The table 2 supports a workpiece 3 under the knife assembly 1.

The knife assembly 1 is movable on vertical plane of frame by cranks 4, 5 on the frame and links 4*a*, 5*a* respectively from the cranks to opposite end portions of the knife assembly. The cranks 4, 5 are rotated by respective motors 4*b*, 5*b*. The motors are preferably electric, but may be pneumatic or hydraulic in other embodiments.

The vertically straight movement up and down of table 2 is driven by hydraulic cylinders 6, 7. The hydraulic cylinders may be screw, gear, pawl, pneumatic or electric mechanisms in other embodiments. Raising the table 2 pushes the workpiece 3 against the knife edge A of the knife assembly 1 while the cranks 4, 5 rotate to move the knife, whereby the knife edge cuts a number of small portions in the veneer with each stroke to slice off the workpiece for a complete sheet of veneer, for example. Top and bottom limit switches 8, 9 limit upward and downward movement of the table.

Figure 2:
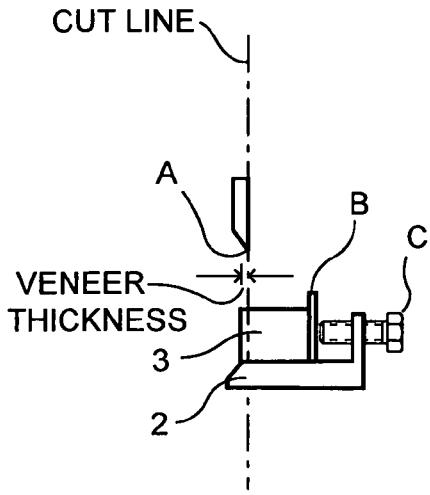
FIG. 2 is a partial right side elevational schematic of the slicer shown in FIG. 1.
Figure 3:
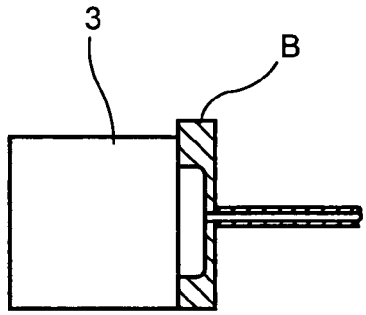
FIG. 3 is a partial enlargement of FIG. 2.

As shown in FIG. 2, the table 2 has a feed screw C to push the workpiece 3 across the table for making successive slices. The feed screw C pushes the workpiece while holding it with a vacuum holding plate B having a suction cup connected to a vacuum line as shown in FIG. 3.

The operation by varying speeds and positions (lengths and/or phases) of the cranks 4,5 makes it possible to set the movement patterns of the knife.

At least and, probably, more importantly, the independent motors 4*b*, 5*b* respectively for the cranks 4, 5 permit initial phases of the movements to be set and maintained by subsequent coordinate rotation or varied by varying the speeds of rotation of the respective cranks. For example, crank 4 can be pulling the knife assembly 1 up while crank 5 is pushing it down on each of these strokes by setting the cranks 180 degrees out of phase and rotating the cranks at the same frequency (speed), or this can occur in transience, merely by rotating the cranks at different frequencies (speeds). Resulting patterns of movements suitable for slicing different materials may thus be selected emperically.

Among these, it has been determined that stroke lengths of about 2 mm at a frequency of about 750 strokes per minute are desirable for slicing thicker slices of dry hardwood for veneer. Finding correlations between stroke lengths and frequencies is more than mere optimization in comparison to art that does not teach any correlation.

Furthermore, the speed of the sliding table at a set of knife movement pattern can determine both output and quality of veneer and can easily be optimized by the machine operator.

For another example, if one of the cranks 4,5 starts turning from about 0 rpm and speeds up to about 1,000 rpm while the other starts from about 1,000 rpm and slows to about 0 rpm, only at the mid-point when both are at frequencies (speeds) of about 500 rpm will the knife tend solely to up and down stroke components.

The concept of the invention is the pressing of the workpiece 3 against the knife edge A to cause cutting by the knife edge due to one or more types of movements by vibrating force, up and down movement, swaying left and right in short and repeated cycles to cut veneer. One of the methods is, thus, movement of the left end of the knife edge vertically in the opposite direction from the right end, and vice versa, in successive strokes.

The table 2 moves up to the upper limit switch 8 while the knife slices one slice with its transverse and parallel, high speed, short-stroke components of movement to make one slice, and then down to the lower limit switch 9. The feed screw C can then be rotated to advance the workpiece the thickness for the next slice and the upward table movement restarted while the suction cup of the table holds the workpiece against the components of movement of the knife edge A.

A block of natural wood is placed on the table 2. The feed screw C is turned to feed a veneer thickness (see FIG. 2) of the wood block under the knife edge A. The vacuum line then provides vacuum to the suction cup to hold the wood block against the feed panel B tightly by the suction. The hydraulic cylinders 6,7 then push the table up and the wood block comes up against the knife edge A. Short-stroke cranks 4,5 move the knife edge with components of each stroke up and down (transverse) and/or end to end (parallel), preferably rapidly (e.g., about 750 strokes per minute at the table slicing speed about 7 strokes per minute). When the table 2 has moved up to the upper limit switch 8, the hydraulic cylinders 6,7 move the table down. At the bottom, the table touches the bottom limit switch 9, and the cycle can be started again.

The invetion claimed is:

1. In a slicer having a table for supporting a workpiece from which a slice is to be sliced, a knife linked to first and second cranks at opposite end portions of the knife for movements of the knife in patterns on x and y of the geometrical plane of cutting having component generally transverse and parallel to the knife and means for moving the table with supported work piece and knife relatively toward each other, the improvements comprising:

controlling means for controlling the movements of the knife by at least one of speed, phase and stroke length of the first of the cranks independently of the second of the cranks.

2. Slicer according to claim 1 wherein the knife ends are in phase and driven by equal speed of cranks.

3. Slice according to claim 1 wherein the knife ends are out of phase and driven by equal speed of cranks.

4. Slicer according to claim 1 wherein the speed of the first of the cranks is different from speed of the second of the cranks.

5. Slicer according to claim 1 wherein the speed of cranks vary between minimum and maximum in a manner of one increasing and the other decreasing simultaneously from bottom and top ranges respectively and alternately.

6. Slicer according to claim 1 wherein the work piece functions in the same manner as the knife.

7. Slicer according to claim 2 wherein the work piece functions in the same manner as the knife.

8. Slicer according to claim 3 wherein the work piece functions in the same manner as the knife.

9. Slicer according to claim 4 wherein the work piece functions in the same manner as the knife.

10. Slicer according to claim 5 wherein the work piece functions in the same manner as the knife.

11. Slicer according to claim 1 wherein the workpiece functions in the same manner as the knife and knife functions in the same manner as the workpiece.

12. Slicer according to claim 2 wherein the workpiece functions in the same manner as the knife and knife functions in the same manner as the workpiece.

13. Slicer according to claim 3 wherein the workpiece functions in the same manner as the knife and knife functions in the same manner as the workpiece.

14. Slicer according to claim 4 wherein the workpiece functions in the same manner as the knife and knife functions in the same manner as the workpiece.

15. Slicer according to claim 5 wherein the workpiece functions in the same manner as the knife and knife functions in the same manner as the workpiece.

16. Slicer according to claim 1 wherein the number of strokes of knife is greater than the number of strokes of the sliding table.

17. Slicer according to claim 2 wherein the number of strokes of knife is greater than the number of strokes of the sliding table.

18. Slicer according to claim 3 wherein the number of strokes of knife is greater than the number of strokes of the sliding table.

19. Slicer according to claim 4 wherein the number of strokes of knife is greater than the number of strokes of the sliding table.

20. Slicer according to claim 5 wherein the number of strokes of knife is greater than the number of strokes of the sliding table.

21. Slicer according to claim 6 wherein the number of strokes of knife is greater than the number of strokes of the sliding table.

22. Slicer according to claim 7 wherein the number of strokes of knife is greater than the number of strokes of the sliding table.

23. Slicer according to claim 8 wherein the number of strokes of knife is greater than the number of strokes of the sliding table.

24. Slicer according to claim 9 wherein the number of strokes of knife is greater than the number of strokes of the sliding table.

25. Slicer according to claim 10 wherein the number of strokes of knife is greater than the number of strokes of the sliding table.

26. Slicer according to claim 11 wherein the number of strokes of knife is greater than the number of strokes of the sliding table.

27. Slicer according to claim 12 wherein the number of strokes of knife is greater than the number of strokes of the sliding table.

28. Slicer according to claim 13 wherein the number of strokes of knife is greater than the number of strokes of the sliding table.

29. Slicer according to claim 14 wherein the number of strokes of knife is greater than the number of strokes of the sliding table.

30. Slicer according to claim 15 wherein the number of strokes of knife is greater than the number of strokes of the sliding table.

* * * * *